US007900858B2

(12) United States Patent
Ragnarsson

(10) Patent No.: US 7,900,858 B2
(45) Date of Patent: Mar. 8, 2011

(54) FAILSAFE SYSTEM FOR MATERIAL APPARATUS

(76) Inventor: Anders Ragnarsson, Chester, NH (US)

( * ) Notice: Subject to any disclaimer, the term of this patent is extended or adjusted under 35 U.S.C. 154(b) by 54 days.

(21) Appl. No.: 12/399,580

(22) Filed: Mar. 6, 2009

(65) Prior Publication Data

US 2009/0224087 A1 Sep. 10, 2009

Related U.S. Application Data

(60) Provisional application No. 61/034,722, filed on Mar. 7, 2008.

(51) Int. Cl.
*B02C 25/00* (2006.01)

(52) U.S. Cl. ..... 241/32; 241/34; 241/36; 241/37; 241/82; 241/186.35; 241/186.4; 241/189.1; 241/285.3

(58) Field of Classification Search ..... 241/31, 241/34, 36, 37, 286–290, 189.1, 186.35, 241/186.4, 82, 285.3, 32
See application file for complete search history.

(56) References Cited

U.S. PATENT DOCUMENTS

| | | | | |
|---|---|---|---|---|
| 3,332,629 | A * | 7/1967 | Miller | 241/33 |
| 4,233,600 | A | 11/1980 | Rogers et al. | |
| 4,441,103 | A | 4/1984 | Urabe | |
| 4,560,110 | A | 12/1985 | Burda | |
| 4,627,578 | A | 12/1986 | Whyte | |
| 4,741,577 | A | 5/1988 | Sato et al. | |
| 4,968,098 | A | 11/1990 | Hirsch et al. | |
| 5,125,188 | A | 6/1992 | Ogawa et al. | |
| 5,363,095 | A | 11/1994 | Normann et al. | |
| 5,713,527 | A * | 2/1998 | Hemesath et al. | 241/189.1 |
| 5,772,128 | A | 6/1998 | McRae | |
| 5,865,382 | A | 2/1999 | Bielagus | |
| 6,736,342 | B2 * | 5/2004 | van Loo | 241/30 |
| 6,766,971 | B2 | 7/2004 | Van Der Beek et al. | |
| 6,868,348 | B1 | 3/2005 | Stoutenburg et al. | |
| 7,048,212 | B2 | 5/2006 | Carey | |
| 7,309,036 | B2 | 12/2007 | Crossley et al. | |
| 7,325,759 | B2 | 2/2008 | Meyer | |
| 7,381,017 | B2 | 6/2008 | Wang et al. | |
| 7,422,391 | B2 | 9/2008 | Holl et al. | |
| 2003/0178515 | A1 | 9/2003 | Boerhout et al. | |
| 2005/0116673 | A1 | 6/2005 | Carl et al. | |

* cited by examiner

*Primary Examiner* — Mark Rosenbaum
(74) *Attorney, Agent, or Firm* — Davis & Bujold, P.L.L.C.

(57) ABSTRACT

A material reducing apparatus comprising a feed conveyor, for conveying material to be reduced, and a feed roller cooperating with the feed conveyor. An upwardly rotatable rotor carrying a plurality of strikers which facilitate reduction of the material to be reduced and an anvil cooperating with the plurality of strikers to facilitate further reduction of the material to be reduced. A grate assembly, located adjacent an arcuate path of the rotor, which permits sufficiently reduced material to pass therethrough. The material reducing apparatus further includes a failsafe system which comprising an accelerometer supported by the rotor and coupled to a control system such that the accelerometer, upon detection of the rotor contacting a hard material, sends a signal to the control system. If the signal indicates a sufficiently large material, the control system reverses a rotational direction of the feed roller so that the feed roll rotates to withdraw the hard material from contact with the rotor. A section of the grate assembly may also be moved away from the rotor, by a release device, upon the release device receiving a command from the control system.

20 Claims, 10 Drawing Sheets

FAILSAFE SYSTEM FOR MATERIAL APPARATUS

FIELD OF THE INVENTION

The present invention relates to a failsafe system for a material reducing apparatus or machine that essentially prevents damage from occurring to the material reducing apparatus or machine when the failsafe system detects an attempted reduction, e.g., a conversion of a large piece of material into smaller, more convenient pieces of material for subsequent handling and recycling purposes, of a "hard" material, such as tramp metal, by the material reducing apparatus or machine.

BACKGROUND OF THE INVENTION

A variety of different materials reducing machines and apparatuses are known in the art which receive large bulky materials, e.g., logs, tree stumps, brush, yard waste, pallets as well as other materials, and process the same for recycling or disposal, for example. Typically a large rotor, containing a plurality of replaceable blades, knives, teeth, hammers or strikers on a peripheral surface thereof, is rotated at relatively high speed so as to strike the incoming material in either a downward or an upwardly arcing path and produce a shearing action of the material to be reduced which assists with conversion of material into smaller pieces which are more convenient for subsequent disposal, handling, recycling, etc.

A feed conveyor is generally provided for feeding material into the downward or the upwardly rotating rotor. A screen generally surrounds a major periphery of the rotating arc of the rotor to assist with the conversion of the large pieces of material into particles of a desired smaller size for subsequent handling and recycling.

A prevalent problem associated with prior art material reducing apparatus is that metal, or some other hard material, tends to be intermixed with the debris, logs, tree stumps, brush, yard waste, pallets or other material to be recycled. If any hard material is attempted to be reduced by the material reducing apparatus, this normally causes the anvil(s), the hammer(s), the striker(s) and/or other internal components within the material reducing apparatus to be dented, chip, fracture and/or break. Prior art attempts to compensate for this have been to provide shear arrangements which allow one or more components to be pivotally supported by shear pins and break away when a hard material is attempted to be reduced by the material reducing apparatus. The problem with such shear arrangements is that, although they are somewhat effective in minimizing damage to the material reducing apparatus, they still result in some damage occurring to the material reducing apparatus which, in turn, leads to costly down time while the material reducing apparatus is shut down so that the chipped, fractured or broken part(s) can be repaired or replaced.

SUMMARY OF THE INVENTION

Wherefore, it is an object of the present invention to overcome the above mentioned shortcomings and drawbacks associated with the prior art.

Another object of the present invention is to provide a failsafe system which when the system detects that the rotor initially strikes or contacts a hard material, such as metal, the failsafe system, substantially immediately upon detecting such contact, reverses the rotational direction of the top feed roller while also reducing the speed of the engine driving the rotor.

Yet another object of the present invention is to provide a failsafe system with a further safety feature which, when the failsafe system detects that a hard material, such as metal, is in the process of actually being reduced by the material reducing apparatus, facilitates an extremely rapid opening of a grate assembly so as to permit the rotation of the rotor to discharge the hard material on to the discharge conveyor before any shearing and/or damage can result to any of the internal components of the material reducing apparatus, e.g., the screen, the anvil(s), for example.

A further object of the present invention is to affix an accelerometer, to a bearing housing supporting the shaft which supports the rotor, such that the accelerometer detects generated vibrations when any of the supported hammers or strikers impacts against a hard material, such as metal, and the accelerometer generates an output signal which is immediately forwarded to main control system which, provided that the detected vibrations is sufficiently large, automatically reverses the rotational direction of the top feed roll to withdrawn the hard material or metal away from the arcing path of the rotor while, at the same time, slowing down the rotational speed of the rotor and also possibly actuating the grate assembly so as to sufficiently space the grate assembly away from the rotating rotor and prevent damage to the internal components of the material reducing apparatus.

Yet a further object of the present invention is to ensure hydraulic actuation of the grate assembly, radially away from a periphery of the rotor, within a time period of about 200 milliseconds or less, and most preferably within a time period of about 20-30 milliseconds following detection of the rotor initially striking or contacting a hard material, such as metal.

A further object of the present invention is to provide a failsafe system which maximizes throughput of the material reducing apparatus while minimizes the possibility of any significant damage occurring to internal grinding/shearing components during operation.

Another object of the present invention is to mount the top feed roller to a pivotal clamshell assembly which facilitates improved access to the hammers or the strikers, the striker or hammer support blocks, the rotor the and the screen or grate, etc., to facilitate servicing and/or replacement of such components.

The present invention also relates to a material reducing apparatus comprising a feed conveyor for conveying material to be reduced; a feed roller cooperating with the feed conveyor for assisting with conveying the material to be reduced; an upwardly rotatable rotor carrying a plurality of strikers which facilitate reduction of the material to be reduced; an anvil cooperating with the plurality of strikers to facilitate further reduction of the material to be reduced; and a grate assembly, located adjacent an arcuate path of the rotor, which permits sufficiently reduced material to pass through openings provided therein; wherein in the material reducing apparatus further includes a control system which comprising an accelerometer supported by the rotor and coupled to the control system, and the accelerometer transmits vibrations signals to the control system, and the control system, when it receives a signal above a threshold, reverses a rotational direction of the feed roller so that the feed roll rotates to withdraw the hard material from contact with the rotor The present invention also relates to A material reducing apparatus comprising: a feed conveyor for conveying material to be reduced; a feed roller cooperating with the feed conveyor for assisting with conveying the material to be reduced; an upwardly rotatable rotor carrying a plurality of strikers which facilitate reduction of the material to be reduced; an anvil cooperating with the plurality of strikers to facilitate further reduction of the material to be reduced; a grate assembly, located adjacent an arcuate path of the rotor, which permits sufficiently reduced material to pass therethrough, the grate assembly comprises a pivotally mounted upper grate assembly and a fixed lower grate assembly; a release device connected for actuation of the uppergrate assembly; and a discharge conveyor for receiving material which passes through the grate assembly to facilitate conveyance thereof; wherein the material reducing apparatus further includes a control system which comprising an accelerometer supported by the rotor and coupled to the control system, and the accelerometer, upon detection of vibration, sending a signal to the control system and the control system, when the controls systems determines that the signal is of a sufficient magnitude, reverses a rotational direction of the feed roller and the feed conveyer so that the feed roll and the feed conveyer rotate to withdraw the hard material from contact with the rotor and the release device pivots the pivotally mounted upper grate assembly radially away from the rotor As used within this patent application, a "hard" material generally refers to a material which has a hardness comparable to that of metal.

BRIEF DESCRIPTION OF THE DRAWINGS

The invention will now be described, by way of example, with reference to the accompanying drawings in which.

DETAILED DESCRIPTION OF THE INVENTION

Figure 1:
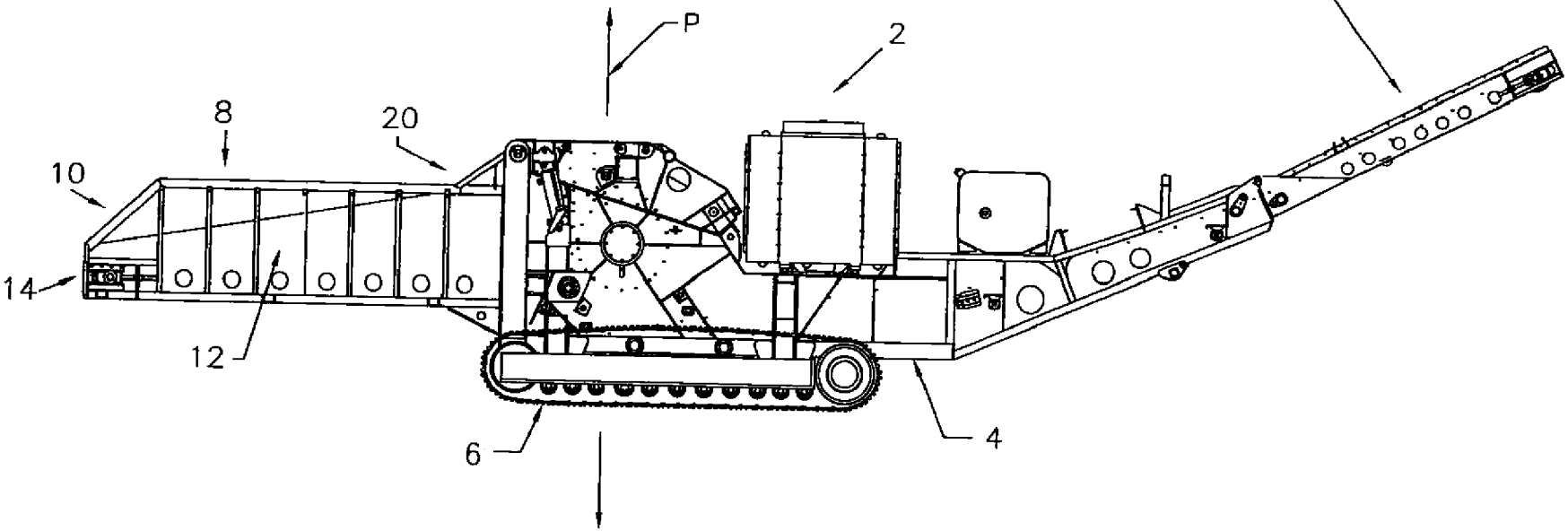
FIG. 1 is a diagrammatic front elevational view of material reducing apparatus according to the present invention.
Figure 1A:
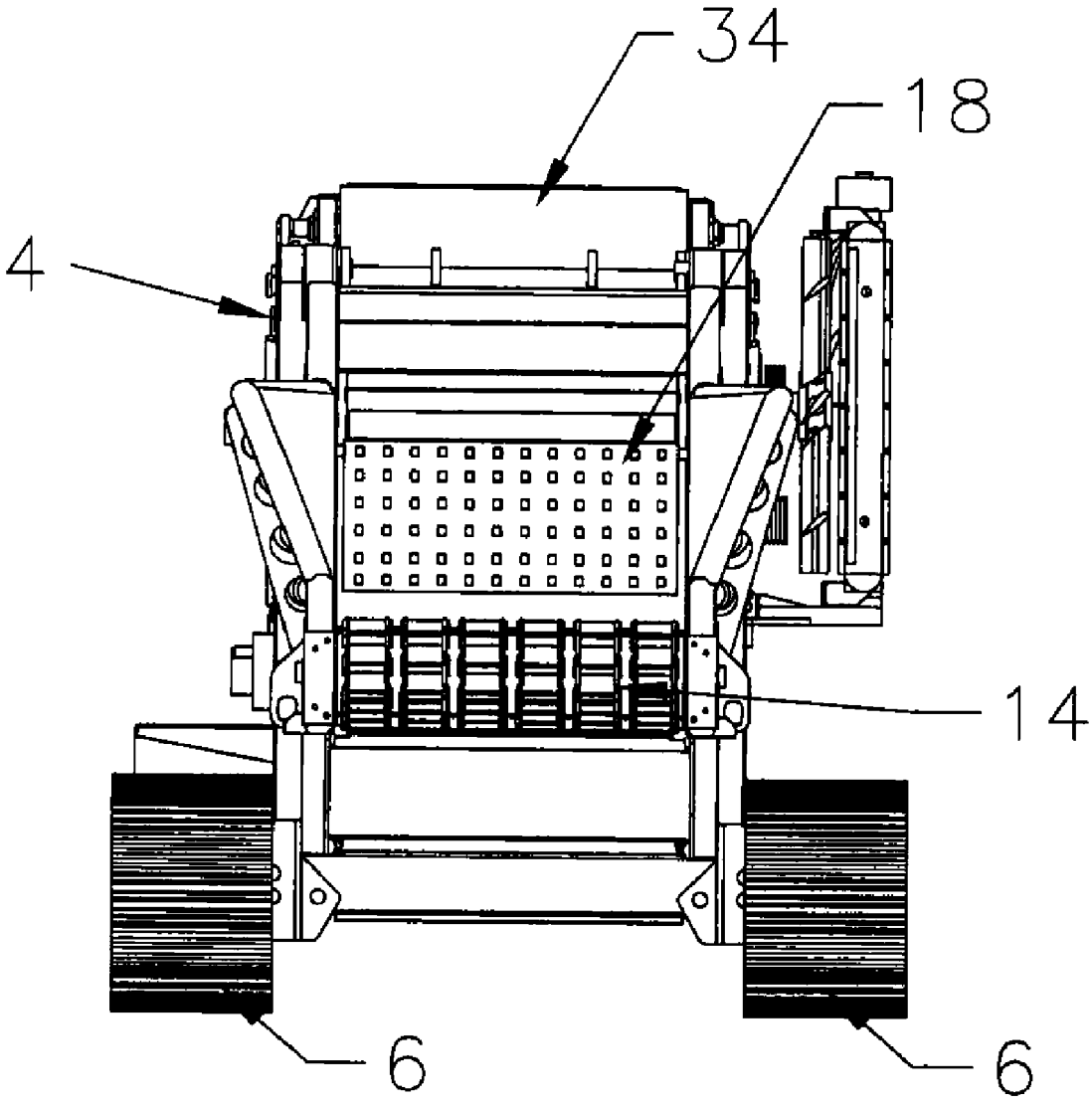
FIG. 1A is a diagrammatic left side elevational view of material reducing apparatus of FIG. 1.
Figure 2A:
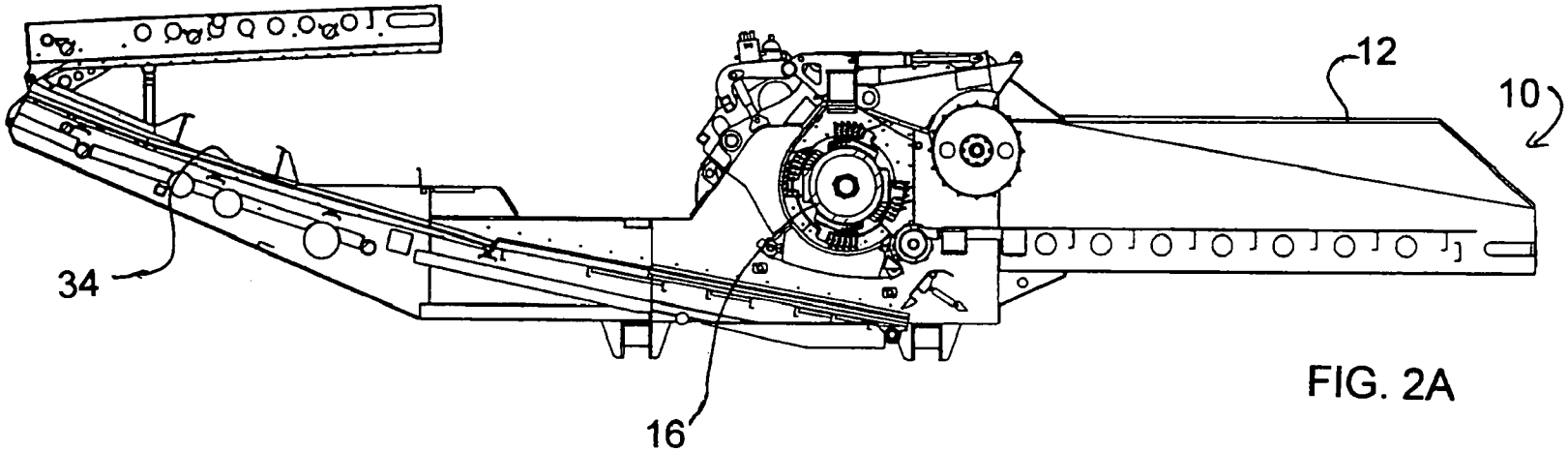
FIG. 2A is a diagrammatic cross section view along section line 2A-2A of FIG. 2.
Figure 2:
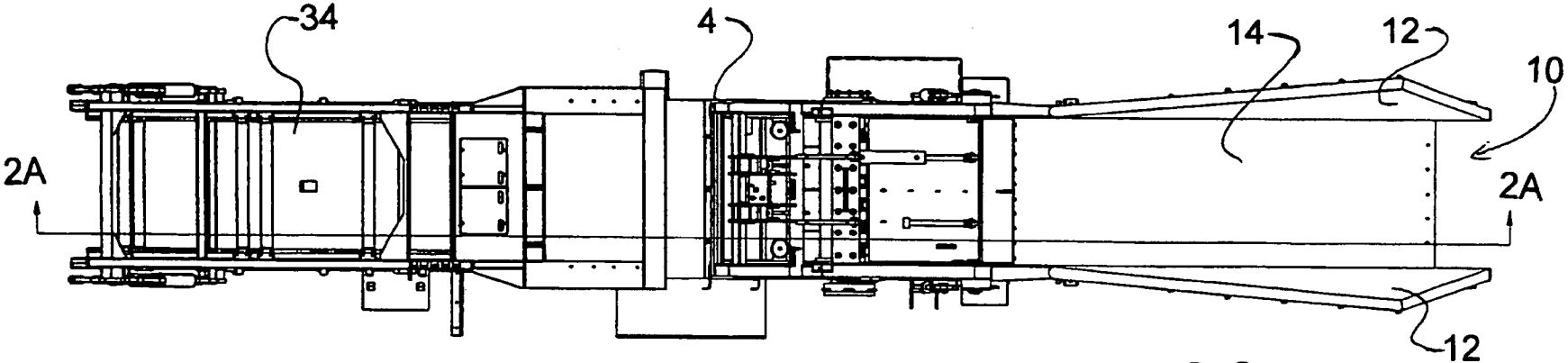
FIG. 2 is a diagrammatic top plan view of the material reducing apparatus with the discharge conveyer shown in a stored transport position.

Turning now to FIGS. 1, 1A, 2 and 2A, a brief description concerning the various components of the present invention will now be briefly discussed. As can be seen in FIG. 1, a material reducing apparatus 2 is diagrammatically shown therein. The material reducing apparatus 2 is arranged to reduce materials such as debris, logs, tree stumps, tree limbs, brush, yard waste, pallets and the like into particles having a desired smaller particle size. According to this embodiment, the material reducing apparatus 2 includes a chassis or frame assembly 4 having a pair of tracks 6 which facilitate travel and maneuverability of the material reducing apparatus 2 to a desired location of a particular work site or onto a transportation trailer. It is conceivable that the chassis or frame assembly 4 may instead include a plurality of rotatable wheels and have a conventional hitch which facilitates connection to a conventional towing unit for towing the material reducing apparatus 2 to a desired site or location. The material reducing apparatus 2 is readily transportable to a site where materials to be reduced have accumulated.

The material reducing apparatus 2 has a receiving bin 8 which includes a feed end 10 for receiving deposited materials that are to be reduced by the material reducing apparatus 2. The receiving bin 8 has a pair of opposed upstanding sidewalls 12 which facilitate containment of the material that is deposited therein. A known feed conveyor 14, such as a belt-type conveyor, extends along a length of the receiving bin 8, e.g., the conveyer 14 has a length of about 18 feet for example, and is provided for conveying the materials to be reduced, which are deposited within the receiving bin 8, toward a material reducing rotor 16 which is positioned adjacent a discharge end of the receiving bin 8. During operation, the conveyor 14 conveys the deposited materials along the feed conveyer 14, in the direction indicated by arrow 15, toward the upwardly rotating rotor 16.

A top feed roller 18, (see FIG. 2) which assists with holding down the material being feed to the rotor 16, is positioned at the discharge end 20 of the feed conveyor 14 immediately adjacent but preceding the rotor 16. Normally, the rotational speed of the feed roller 18 will be automatically controlled, via a main control system 22, depending upon the load of the engine 24 driving the rotor 16. The feed roller 18 normally assists with compaction or crushing of the material to be reduced and also assists the feed conveyor 14 with conveying the material to be reduced into the rotational path of the rotor 16. It is to be appreciated that the materials fed into the rotor 16 are partially reduced when such materials are impacted by the strikers or hammers 26 which are mounted to the peripheral surface of the rotor 16. To assist with further reduction of the material, at least one anvil(s) 28 is strategically positioned along a width of the rotor 16, but slightly radially spaced therefrom, such that the strikers or hammers 26, carried by the rotor 16, will pass closely adjacent to the anvil(s) 28, without contacting the anvil(s) 28, and the material is further sheared/reduced in a conventional manner into smaller particles by such interaction of the strikers or hammers 26 rotating past and slightly underneath the anvil(s) 28.

A conventional grate assembly 30, such as a screen or grate, is located after the anvil(s) 28 and this grate assembly 30 only allows material of up to a specified size, i.e., determined by the size of the holes or openings 32 provided in the grate assembly 30, to pass through the grate assembly 30 and onto a discharge conveyer 34. The material that is reduced, by the material reducing apparatus 2, to or less than the specified size readily passes through openings 32 in the grate assembly 30 and is deposited on the discharge conveyor 34 located vertically under the grate assembly 30. The grate assembly 30 in combination with the strikers or hammers 26 produce a conventional shearing action of the material which assists with further reduction of the material. The discharge conveyor 34 then conveys the screened material either to a desired container or merely onto a storage pile. Separated conventional power or drive sources (not shown or described in further detail) provide driving power to both the feed and the discharge conveyors as well other components of the material reducing apparatus 2.

Figure 3:
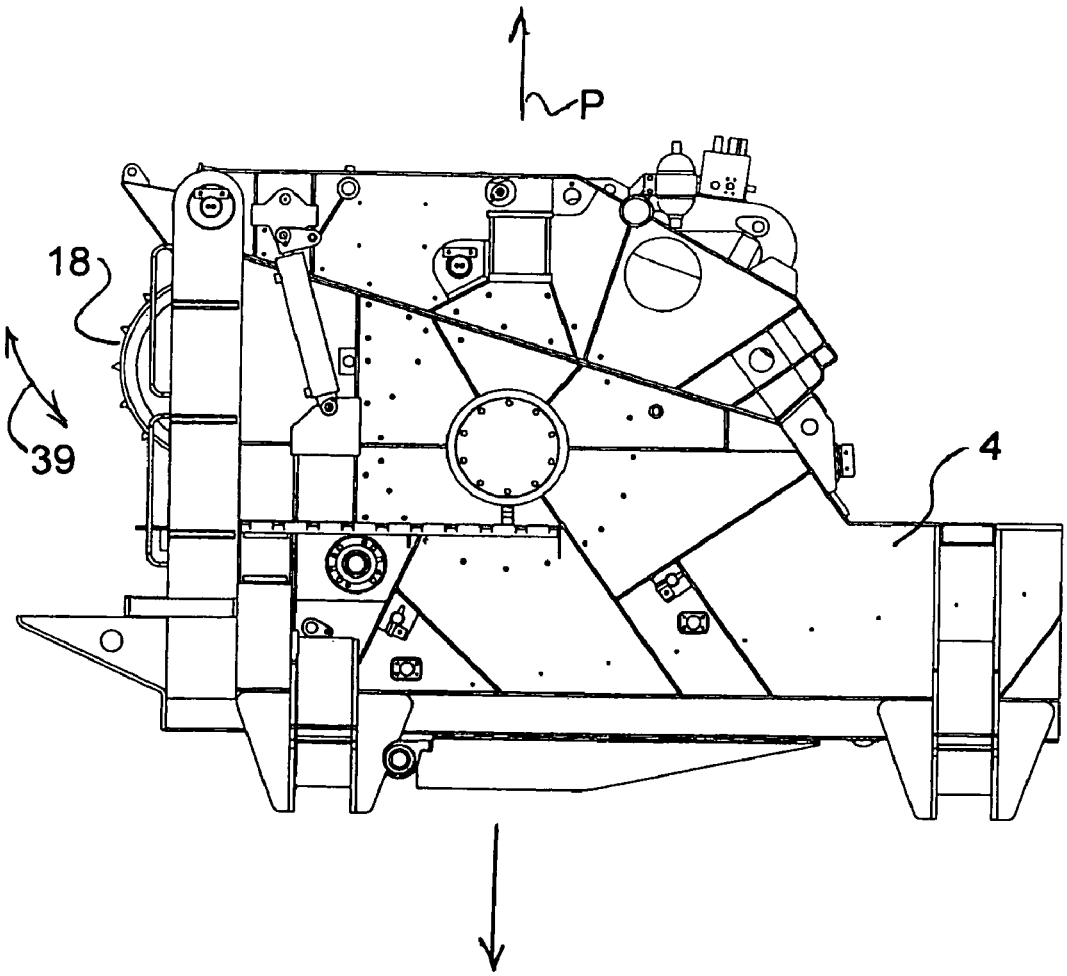
FIG. 3 is a diagrammatic front elevational view of hog box of the material reducing apparatus shown in the closed operative position.
Figure 3A:
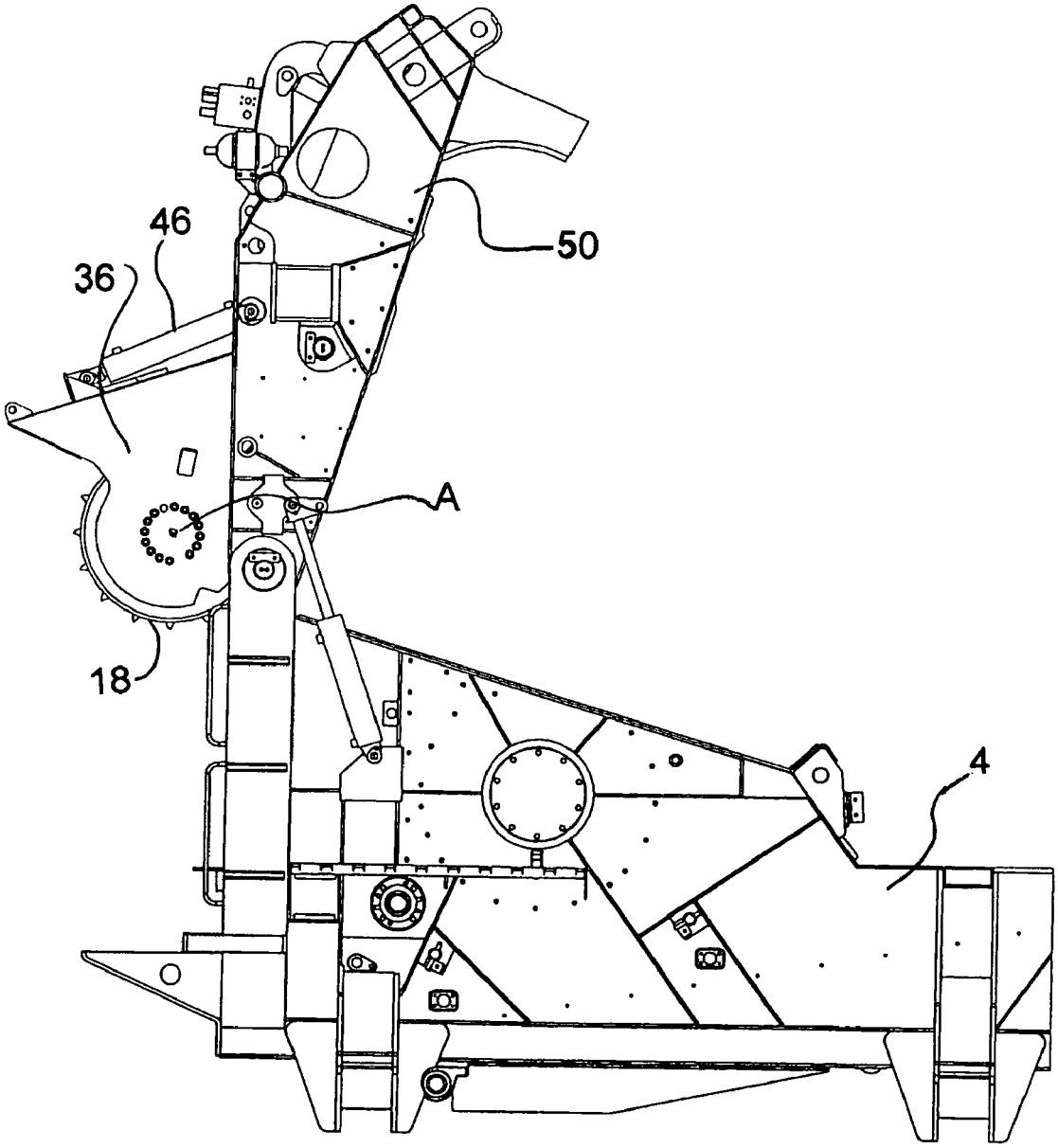
FIG. 3A is a diagrammatic front elevational view of hog box of the material reducing apparatus shown in the opened, servicing position.

As previously mentioned, the feed conveyor 14 extends along the length of the receiving bin 8 and conveys the material that is deposited into the receiving bin 8 toward the rotor 16. The feed roller 18 is positioned adjacent to the discharge end of the conveyor 14 and a first end of a pair of arms 36 (see FIG. 3A) support the feed roller 18 while an opposite end of the pair of arms 36 are pivotally supported by the chassis or frame assembly 4. The pivot point or location of the pair of arms 36 is designated as element 38 and is located generally forward of a vertical plane P which extends through and bisects the rotor 16 into two halves, i.e., the pivot point 38 is located between the vertical plane P and a rotational axis A of the feed roller 18. The feed roller 18 is thus simultaneously pivotable toward and away from both the rotor 16 and the discharge end 20 of the feed conveyor 14. Such pivotal movement of the feed roller 18 is generally indicated by double arrow 39.

The pair of arms 36 also support a shroud or hood 40 which encloses a portion of the feed roller 18 and assists with channeling and redirecting all of initially impacted material toward the anvil(s) 28 where such material may be further reduced by a shearing action between the strikers or hammers 26 and the anvil(s) 28. A drive mechanism 42 for the feed roller 18 may either by carried by the chassis or frame assembly 4 or is preferably mounted to the arms 36 and provides additional weight for biasing the feed roller 18 downwardly toward the feed conveyer 14 as this generally assists with holding down the material to be reduced as such material is being impacted by the strikers or hammers 26 of the rotor 16. The exterior surface of the feed roller 18 typically has a plurality of nubs or other protrusions 44 which provide a gripping action that assists with conveying the material as the feed roller 18 normally rotates in its forward feed direction.

The weight of the feed roller 18, the drive mechanism 42, the arms 36 and the associated components mounted to the arms 36 along with the rotation of the feed roller 18 assist with forcing the material under the feed roller 18 where such material is initially crushed/compacted between the feed roller 18 and the feed conveyor 14 as the material is continuously fed to the rotor 16. Normally the arms 36 of the feed roller 18 are at least hydraulically actuated by a pair of hydraulic feed roller actuators 46 to assist with raising and lowering the feed roller 18 away from and toward the feed conveyer 14. The pair of hydraulic feed roller actuators 46 respectively couple the chassis or frame assembly 4 to the pair of arms 36 to facilitated pivoting movement of the feed roller 18 about its pivot point 38. The main control system 22 controls operation of the pair of hydraulic feed roller actuators 46 to allow infinite adjustment of the downward pressure that the feed roller 18 can exert on the material to be reduced.

The main control system 22 controls the feed roller 18 so that it rotates at a rate such that its peripheral speed is either the same as or greater than a travel speed or rate of the feed conveyor 14. When the feed roller 18 rotates at a higher rotational speed, any material that may be piled high in the receiving bin 8t e.g., tree, branches, limbs, brush, pallets, etc., is pushed down and into the entrance of the rotor 16 at a more rapid rate than the conveyor speed 14. This speed difference tends to relieve any congestion at the entrance as long as the material is rapidly cleared away from the entrance to the rotor 16 which is normally accomplished by the rotor 16 rotating at a speed of between 1,000-1,800 rpms, for example.

As is conventional in the art, a periphery of the rotor 16 has a plurality of spaced apart striker or hammer support blocks 48 mounted to the exterior surface of the rotor and each striker or hammer support block 48 supports a replaceable striker or hammer 26. Typically, the striker or hammer support blocks 48, e.g., about 24 striker or hammer support blocks, are strategically arranged, e.g., in an offset helix layout, for maximum grinding efficiency. Each striker or hammer support block 48 supports a striker or hammer 26 to the rotor 16 in a conventional manner, via at least one bolt for example, such that the strikers or hammers 26 rotate at a relatively high rate of speed for impact against the material that is being conveyed into the rotor 16 by the feed roller 18 and the feed conveyor 14. As noted above, a conventional engine 24 drives the rotor 16 in an upward rotational direction, as indicated by arrow 21. Since the rotor 16 is driven at a much higher rotational speed than both the feed roller 18 and the feed conveyer 14, the strikers or hammers 26 effectively reduce the material by an impact cutting action. The particles thus reduced by the strikers or hammers 26 are propelled and redirected by the shroud or hood 40 toward the anvil(s) 28. The particles then impact against the anvil(s) 28 which, in combination with the striker or hammer 26, further reduce the particles through shear cutting action.

The anvil(s) 28 is fixedly mounted to a portion of a pivotal clamshell assembly 50 which is pivotal relative to a remainder of the chassis or frame assembly 4 to facilitated maintenance and/or servicing of the internal components. As a result of such arrangement, the anvil(s) 28 is fixedly mounted to cooperate with the strikers or hammers 26, during operation, and shear or reduce the material. The interaction of the strikers or hammers 26 with the anvil(s) 28 typically shear the material, that was initially partially reduced by impact with the strikers or hammers 26, to further reduce the material to a size that will readily pass through the openings in the grate assembly 30. It is to be appreciated that the openings 32 in the grate assembly 30 can have any desired size so that the material can be reduced to anywhere from a course particle end product to a more uniform very fine end product.

Figure 5A:
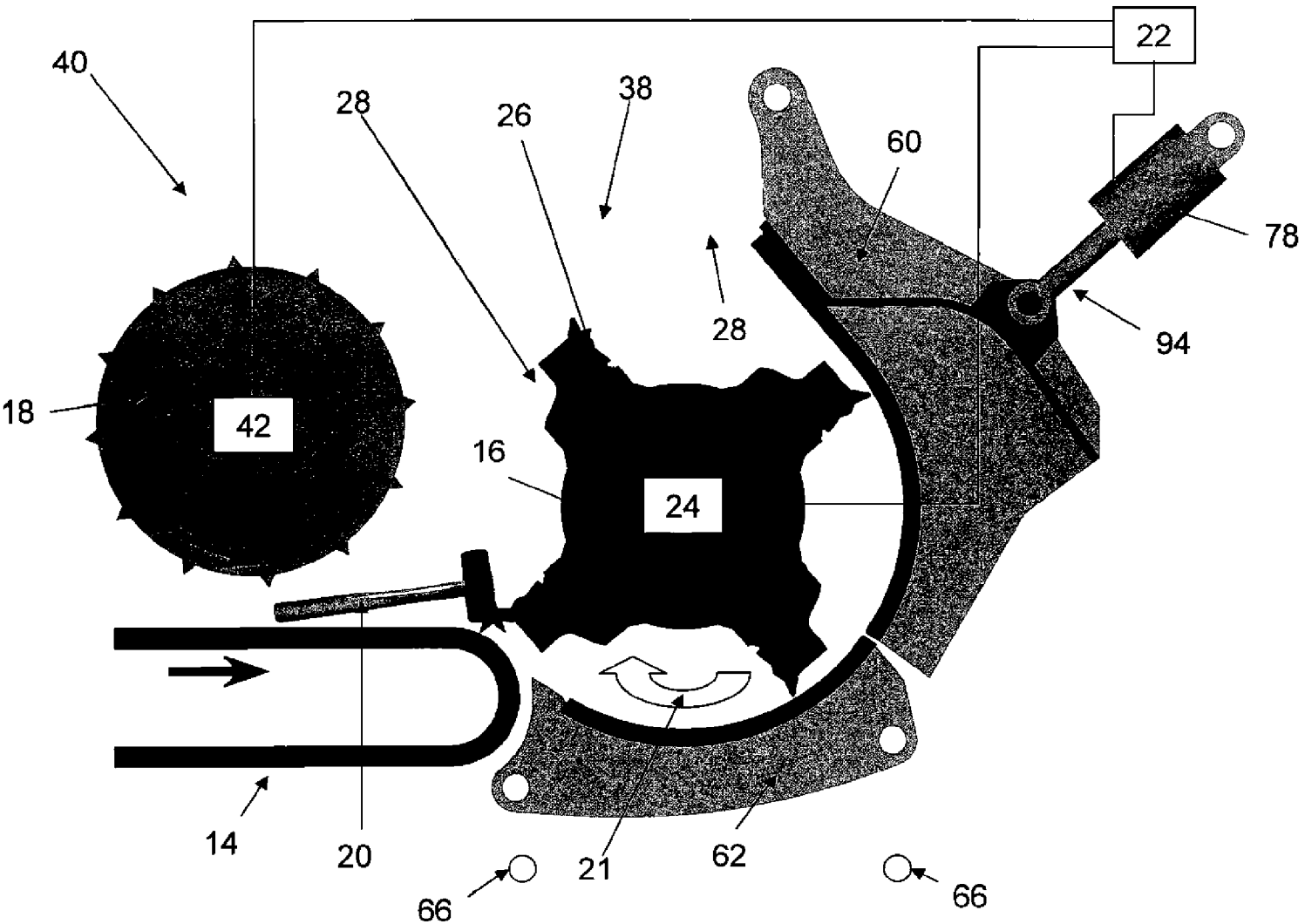
FIG. 5A is a diagrammatic view showing the normal grinding/reducing operation of material reducing apparatus.

The grate assembly 30 generally has a curved profile, which closely conforms to the rotational path of the rotor, and has a plurality of openings therein. A first end of the grate assembly 30 is mounted adjacent the anvil(s) 28 and receives the material as such material is reduced by the shearing action. The material that is substantially reduced but still too large to readily pass through the openings 32 in the grate assembly 30 will be forced by the strikers or hammers 26 against the grate (located in close proximity to the rotor teeth) to further break up the material typically to a size that will pass through the openings. As will be noted from FIGS. 5A-5C, the grate assembly 30 generally extends from the anvil(s) 28 around the periphery of the rotor to the position adjacent the discharge end 20 of the conveyor 14. The material passing through the grate assembly 30, at any point between the anvil(s) 28 and the discharge end of the conveyor 14, is normally deposited on the discharge conveyor 34 for transfer.

The grate assembly 30 generally comprises two mating sections 60, 62 which, when mated together, form the grate assembly 30 which extends from the anvil(s) 28 around the periphery of the rotor 16 to the position adjacent the discharge end 20 of the conveyor 14. The upper section 60 of the grate assembly 30 is normally pivotally connected, at pivot point 64, to the chassis or frame assembly 4 to allow the upper section 60 of the grate to be pivoted radially away from the rotating strikers or hammers 26 and the rotor 16 in the event that a hard material or metal is in the process of being reduced. The upper section 60 is coupled to a high speed release device 78 which rapidly, e.g., within less than about 200 milliseconds, moves/pivots the upper section 60 of the screen assembly 30, about its pivot point 64, to adequately space the screen or grate 104 of the upper section 60 away from the strikers or hammers 26 of the rotor 16 and prevent any damage from occurring to the internal components of the material reducing apparatus 2. A further discussion concerning operation of the high speed release device 78 will follow below.

The lower section 62 of the grate assembly 30 is supported, in normally a fixed manner, adjacent the strikers or hammers 26 of the rotor 16. However, a number of shear pins 68 connect the lower section 62 to the chassis or frame assembly 4 so that in the event that the lower section 62, for some reason, is impacted significantly by a hard material, one or more of the shear pins 68 will shear away, in a conventional manner, and allow the lower section 62 to pivot or fall, due to gravity, away from the rotor 16. A hook or stop feature 66 is provided so as to prevent the lower section 62 from falling too far away from the rotor 16 and inadvertently causing damage to the lower section 62. This break away arrangement thus minimizes the amount of damage which may otherwise occur to the internal components of the material reducing apparatus 2.

Instead of the release device 78 for the uppergrate assembly 60, the upper grate assembly 60 may be mounted so as break away when subjected to a significant impact, e.g., at least one shear pin (not shown) may be provided for retaining the upper grate assembly 60 in a normally fixed operational position. In the event that the upper grate assembly 60 is struck by a relatively hard material, then such impact against the upper grate assembly 60 causes the shear pins, which retains the upper grate assembly 60 in a fixed position, to shear or break and minimize damage to the internal components. This safety feature generally minimizes undesired jamming or significant damage to the internal components, such as the rotor 16, the strikers or hammers 26, the striker or hammer support blocks 48 and/or the anvil(s) 28 during operation.

Alternatively, instead of having a substantially fixed anvil (s) 28, the anvil(s) 28 may be mounted so as break away along with the upper grate assembly 60 when subjected to a significant impact, e.g., at least one shear pin (not shown) may be provided for retaining the anvil(s) 28 and the upper grate assembly 60 in a fixed operational position. That is, both the anvil(s) 28 and the upper grate assembly 60 are mounted so as to shear one or more pivot pins, when subjected to a significant impact, and pivot about a pivot axis or point 64. As a result of such arrangement, in the event that the anvil(s) 28 and/or the upper grate assembly 60 is struck by a relatively hard material that is not readily shearable by the strikers or hammers 26 and the anvil(s) 28, then such impact against the anvil(s) 28 causes the shear pins, which retains the anvil(s) 28 and the upper grate assembly 60 in a fixed position, to shear or break and minimize damage to the internal components. This safety feature generally prevents undesired jamming or significant damage to the internal components, such as the rotor 16, the strikers or hammers 26, the striker or hammer support blocks 48 and/or the anvil(s) 28 during operation.

Figure 4:
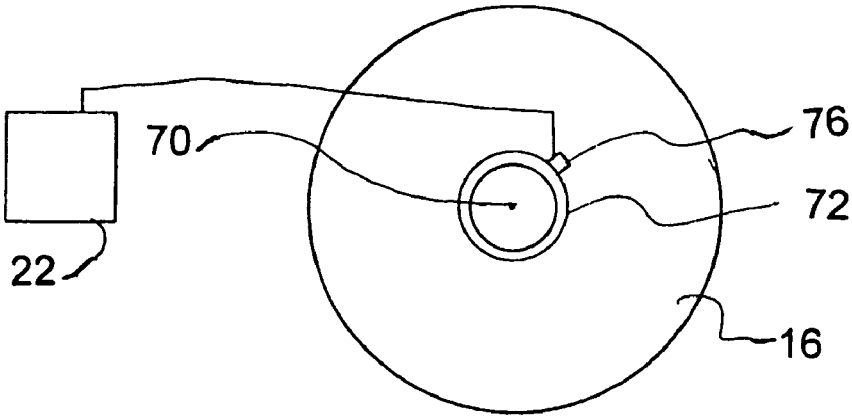
FIG. 4 is a diagrammatic view showing the accelerometer supported by the bearing housing for the rotor.

The shaft 70 of the rotor 16 is provided with an accelerometer 76 (see FIG. 4) which is mounted to a bearing housing 72 of the shaft 70 supporting the rotor 16. The accelerometer 76 detects the impact of the strikers or hammers 26 with any hard material or object, such as metal, e.g., and the vibrations transmitted to the rotor 16 and the shaft 70 caused by the strikers or the hammers 26 impacting against a hard material. Depending upon the sensitivity of the accelerometer 76, the accelerometer 76 can be adjusted to detect contract of the strikers or hammers 26 with virtually any material having a specific hardness. When the accelerometer 76 detects such contact, the accelerometer 76 generates an output signal which is sent to the main control system 22 for evaluation.

Figure 5B:
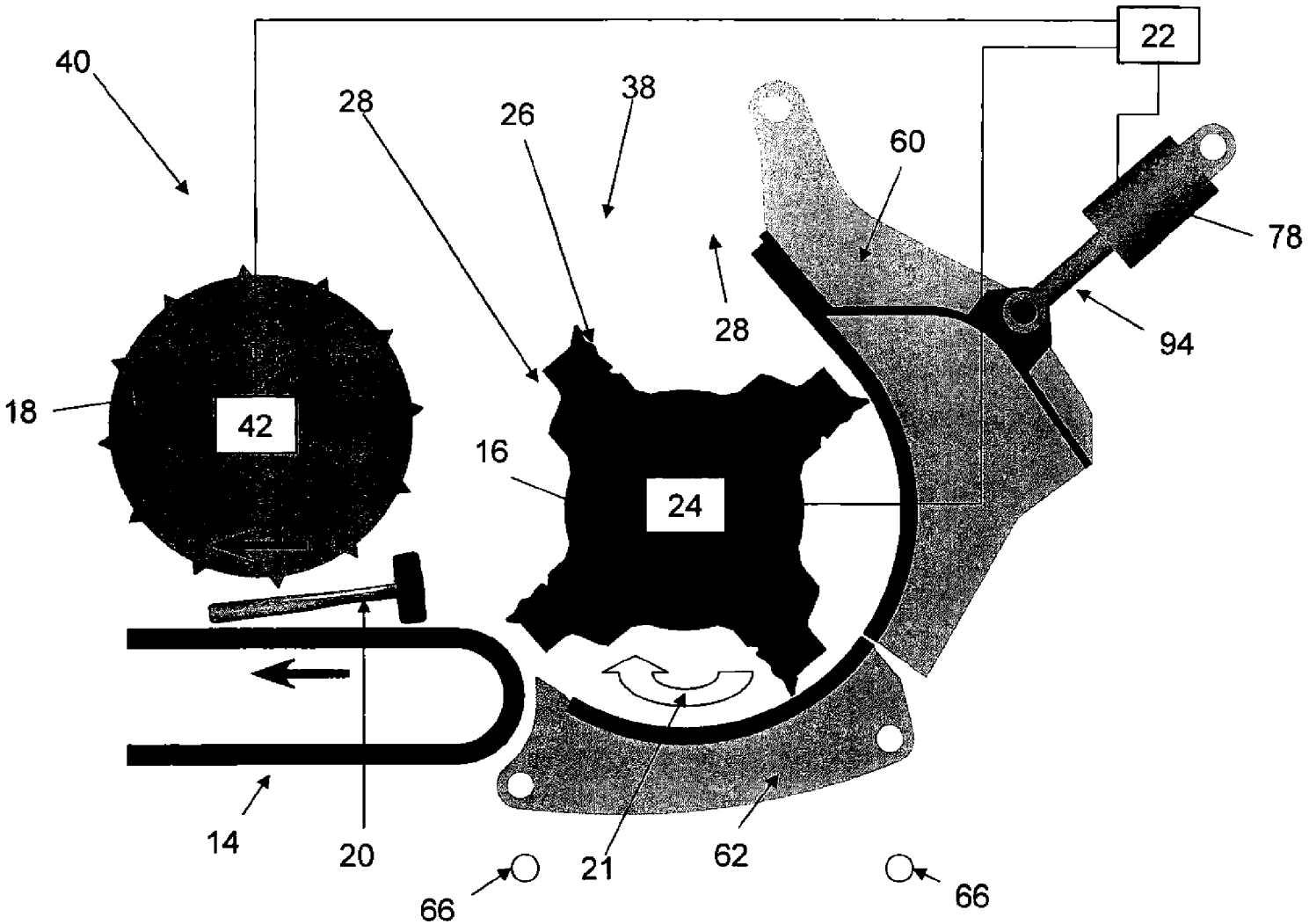
FIG. 5B is a diagrammatic view showing reversal of the feed roller upon the accelerometer detecting contact of the rotor with a hard material.
Figure 5C:
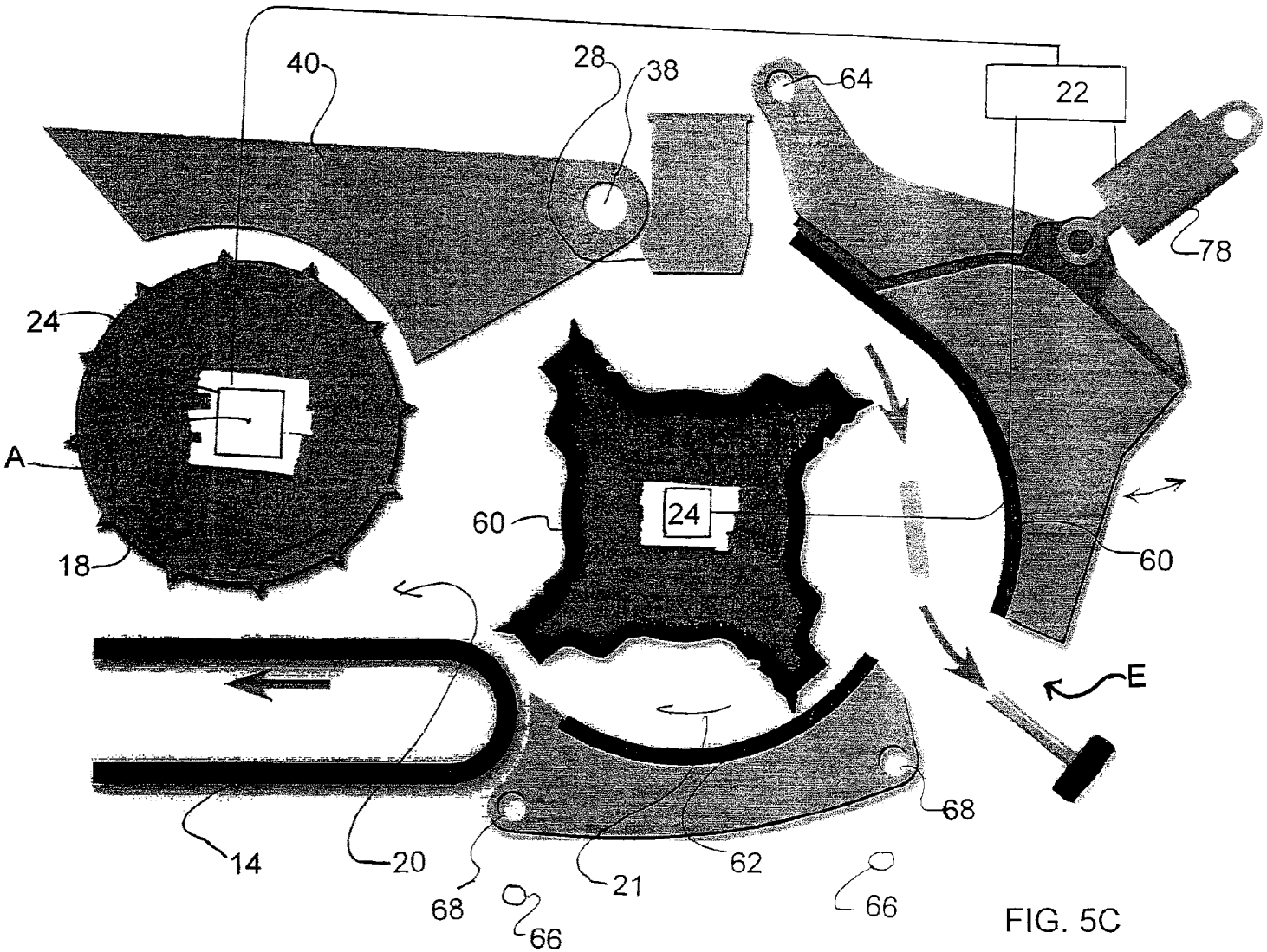
FIG. 5C is a diagrammatic view showing both reversal of the feed roller and actuation of the release device upon the accelerometer detecting contact of the rotor with a hard material.

In the event that the main control system 22 determines that the strikers or hammers 26 contacted a material having a specific hardness (see FIG. 5A), e.g., the detected vibration is above a certain level and/or the rotor 16 experiences a specified load, the main control system 22 immediately sends a signal to reverse the rotational direction of the feed roller 18 so that the feed roller 18 immediately rotates in an opposite rotational direction, i.e., rotates in a direction which withdraws the material from the rotational path of the rotor 16 (see FIG. 5B). The rotational direction of the feed conveyer may also be automatically reversed as shown in FIG. 5B.

In combination with such reversal motion of rotational direction of the feed roller 18, the control system 22 also slows down the engine 24 which drives the rotor 16, or may possibly completely stop rotation of the rotor 16. Once this occurs, an operator can then shut down any other operating components and inspect the material reducing apparatus 2 and undertake any necessary corrective action, e.g., remove any metal or other hard material from the material reducing apparatus 2 before such hard material can cause any damage to the internal components of the material reducing apparatus 2.

In the event that multiple signals are detected by the accelerometer 76 within a short duration of time, the main control system 22 can undertake more drastic corrective action such as (see FIG. 5C), in addition to reversing the rotational direction of the feed roller 18 and reducing the rotational speed of the rotor 161 the control system 22 can also hydraulically actuate and pivot the upper grate assembly 60 radially away from the rotation path of the strikers or hammers 26. This is accomplished by very quickly actuating the release device(s) 78 to move the upper grate assembly 60 radially away from the rotor 16 within a response time of about 200 milliseconds or less and most preferably moving the upper grate assembly 60 radially away from the rotor 16 within a response time of about 20 to 30 milliseconds following generation of the signal by the accelerometer 76.

Figure 6:
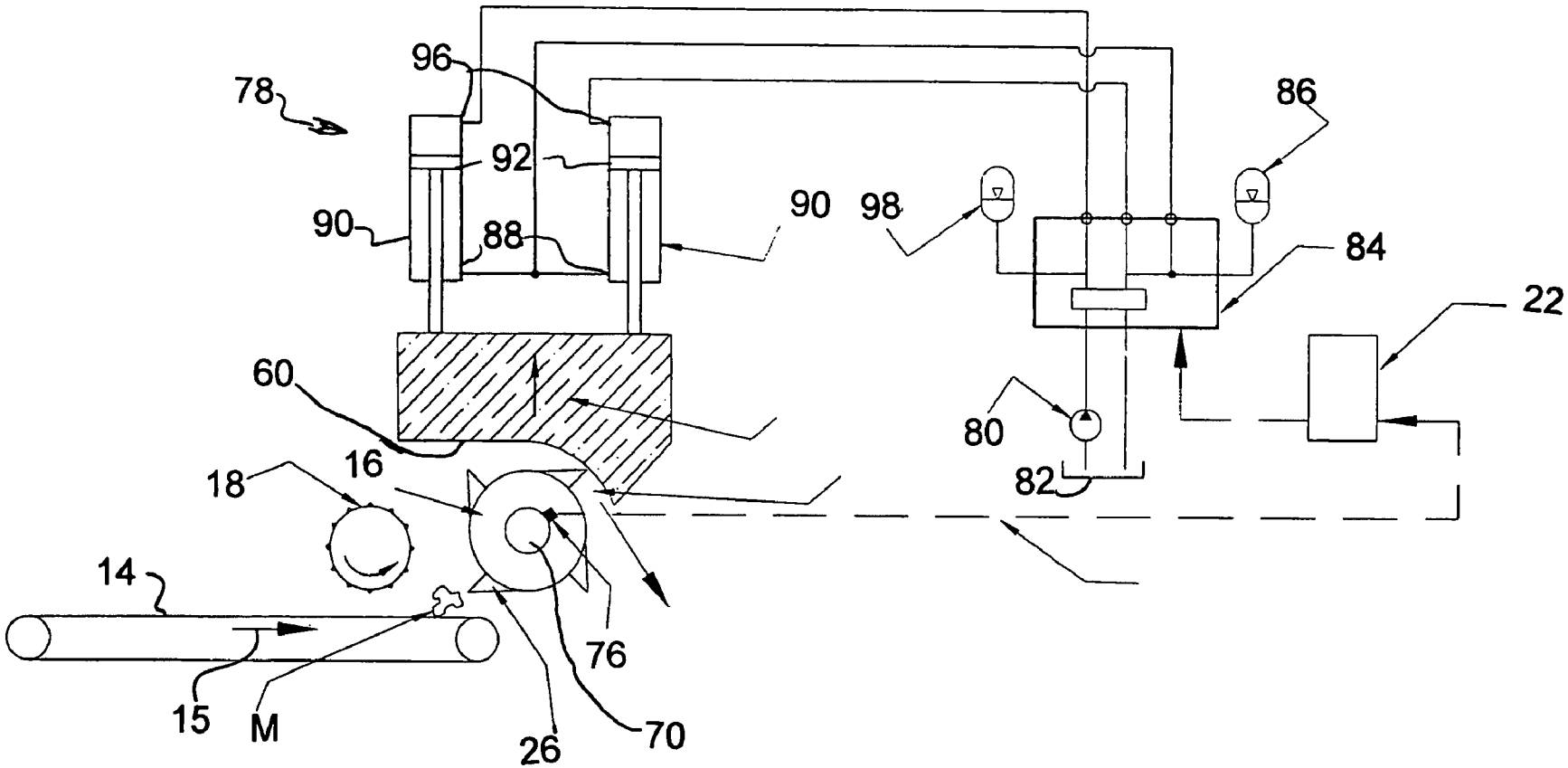
FIG. 6 is a diagrammatic view of hydraulic system for actuating the release device.

As can be seen in FIG. 6, a hydraulic pump 80 operates when the material reducing apparatus 2 is initially started. This pump 80 pumps hydraulic fluid from a sump 82 to a release manifold 84 where the supplied hydraulic fluid is stored in a primary accumulator 86 as potential energy for actuating the release device 78. When a sufficiently large "hard" piece of material, such as metal, contacts a striker(s) or hammer(s) 26 of the rotor 16, this vibration generated by such contact travels through the rotor 16 and the shaft 70 to the accelerometer 76 where the vibration is detected and measured. The accelerometer 76 will, in turn, generate a signal indicative of the detected vibration(s) and transmit this signal to the control system 22 where the signal is analyzed, in a conventional manner, to determine the potential size and/or type of material which was contacted by the striker(s) or the hammer(s) 26 or the rotor 16. If the received signal is determined to be too high, e.g., above a desired threshold, then the control system 22 determines that the striker(s) or the hammer (s) 26 contacted a "large" piece of hard material or metal M and immediately sends a signal to the release manifold 84. Through internal valving, not shown in detail, the release manifold 84 releases the stored hydraulic fluid stored within the primary accumulator 86 and this energy is rapidly conveyed to an input side 88 of one or more cylinders 90 of the release device 78 which rapidly bias the respective internal piston 92 away from the pivotal upper grate assembly 60. As the upper grate assembly 60 is respectively connected to the internal pistons 92 via a linkage arm 94, such movement also causes the upper grate assembly 60 to be carried away from the rotating path of the rotor 16. The entire release operation, which sufficiently spaces the upper grate assembly 60 radially away from the rotating path of the rotor 16 by at least a few inches or so, occurs within about 170 milliseconds. It is to be appreciated that the upper grate 60 assembly must be adequately spaced from the rotating path of the rotor 16 so as to allow sufficient clearance for the large "hard" piece of material M to pass between the upper grate assembly 60 and the rotor 16, without causing any significant damage to the internal components of the material reducing apparatus 2, and be ejected through an ejection opening E formed in the grate assembly onto the discharge conveyor 34.

While the hydraulic fluid is rapidly conveyed to the input side 88 of the release cylinders 90 from the primary accumulator 86, hydraulic fluid is also rapidly conveyed from an opposite side 96 of the release cylinders 90, via internal valving not shown in detail, and this hydraulic fluid is collected and stored in a restoring accumulator 98 so that the large rush of hydraulic fluid, from the release cylinders 90, is adequately controlled. The hydraulic fluid which collects and is stored in the restoring accumulator 98 can be utilized to rapidly return the upper grate assembly 60 to its normal operational position adjacent the rotating path of the rotor 16 or, alternatively, may be subsequently dumped into the sump 82.

To facilitate such rapid actuation of the upper grate assembly 60, the primary accumulator 86 is typically able to supply of about 30 gallons per second of the hydraulic fluid to the release device 78. In addition, restoring accumulator 98 is generally able to accommodate removing of about 150 gallons per second of hydraulic fluid from the opposite side of the release cylinders 90. By transferring such high volumes or hydraulic fluid to and removing hydraulic fluid from the release device 78, the release device 78 responds very rapidly and is thus able to substantially instantaneously pivot the uppergate assembly 60 about its pivot point 64 to sufficiently space the upper grate assembly 60 away from the strikers or hammers 26 and thereby minimize the possibility of any damage occurring to the internal components as a result of a hard material or metal being reduced within the material reducing apparatus 2.

Figure 7B:
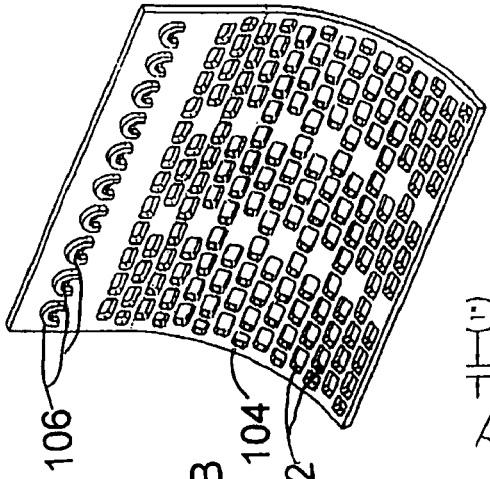
FIGS. 7 is diagrammatic front elevational view showing the horseshoe shaped protectors for protecting the bolt heads secure the upper grate to the upper grate assembly, 7A is a right side elevation view thereof, and 7B is a perspective view thereof.
Figure 7A:
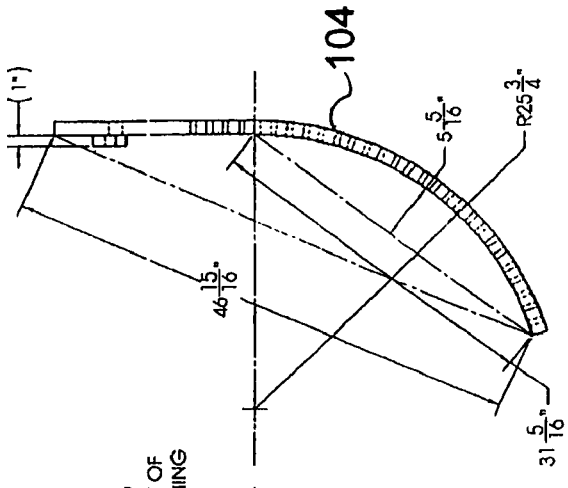
Figure 7:
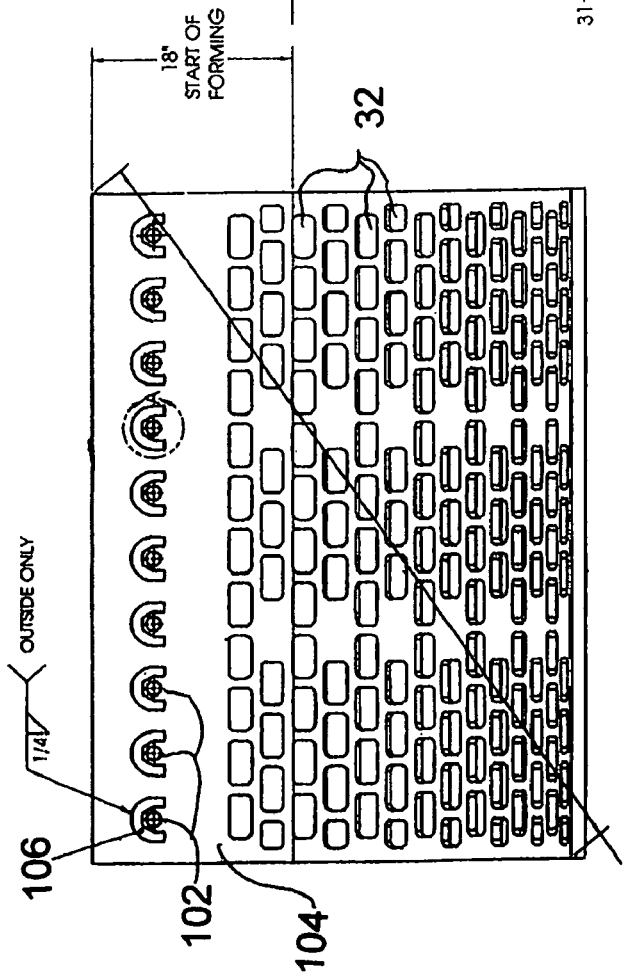

As can be seen in FIGS. 7-7B, the upper grate assembly 60 normally has a number of bolts 102 which secure the screen or grate 104 (e.g., 1 to 1½ inch thick plate metal which has a plurality of rectangular holes 108 burnt therethrough and bent into a generally curved profile) to the upper grate assembly 60. Typically eight bolts 102 are utilized to secure the screen or grate 104 to the upper grate assembly 60 and a mating horseshoe shaped protective shrouds 106 are utilized to protect the heads of the bolts 102 as well as prevent rotation thereof while also preventing premature wear of the bolt heads.

The upward cutting action of the strikers or hammers 26 induces a flow pattern that is beneficial for discharging the reduced material through the grate assembly 30. The strikers or hammers 26, as they impact and then sever the material being fed by the conveyor 14 and the feed roller 18, is normally propelled upwardly along the shroud or hood 40 and thus essentially will be flowing in an air flow through the grate assembly 30.

Since certain changes may be made in the above described failsafe system for a material reducing apparatus or machine, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A material reducing apparatus comprising:

a feed conveyor for conveying material to be reduced;

a feed roller cooperating with the feed conveyor for assisting with conveying the material to be reduced;

an upwardly rotatable rotor carrying a plurality of strikers which facilitate reduction of the material to be reduced;

an anvil cooperating with the plurality of strikers to facilitate further reduction of the material to be reduced; and a grate assembly, located adjacent an arcuate path of the rotor, which permits sufficiently reduced material to pass through openings provided therein;

wherein the material reducing apparatus further includes a control system which comprises an accelerometer supported by the rotor and coupled to the control system, and the accelerometer transmits vibration signals to the control system, and when the control system receives a vibration signal above a threshold, the control system reverses a rotational direction of the feed roller so that the feed roller rotates to withdraw hard material, that is not readily shearable by the strikers, from contact with the rotor, and actuates the grate assembly to form an ejection opening, in the grate assembly, for ejecting ungrindable material from the material reducing apparatus.

2. The material reducing apparatus according to claim 1, wherein a section of the grate assembly is movable away from the rotor by a release device to create the ejection opening, and the control system is coupled to the release device and only actuates when the release device receives a release signal from the control system.

3. The material reducing apparatus according to claim 2, wherein the release device moves the section of the grate assembly away from the rotor within about 200 milliseconds.

4. The material reducing apparatus according to claim 2, wherein the grate assembly comprises a pivotally mounted upper grate assembly and a fixed lower grate assembly, and the release device only pivots the upper grate assembly radially away from the rotor about a pivot axis to create the ejection opening in the grate assembly.

5. The material reducing apparatus according to claim 4, wherein the lower grate assembly is supported by shear pins which, when exposed to a predetermined force, will shear away and allow the lower grate assembly to fall away from the rotor.

6. The material reducing apparatus according to claim 5, wherein the material reducing apparatus is provided with stop pins which limit radially downward movement of the lower grate assembly, away from the rotor, when the shear pins are sheared.

7. The material reducing apparatus according to claim 1, wherein the control system further reduces a rotational speed of the rotor when the control system determines that the rotor contacted the hard material.

8. The material reducing apparatus according to claim 1, wherein the accelerometer is supported by a bearing housing for the rotor.

9. The material reducing apparatus according to claim 1, wherein a discharge conveyor is located to receive the sufficiently reduced material which passes through the openings provided within the grate assembly and facilitates conveyance thereof.

10. A material reducing apparatus comprising:

a feed conveyor for conveying material to be reduced;

a feed roller cooperating with the feed conveyor for assisting with conveying the material to be reduced;

an upwardly rotatable rotor carrying a plurality of strikers which facilitate reduction of the material to be reduced;

a fixed anvil cooperating with the plurality of strikers to facilitate further reduction of the material to be reduced;

a grate assembly, located adjacent an arcuate path of the rotor, which permits sufficiently reduced material to pass there through, the grate assembly comprises a pivotally mounted upper grate assembly and a fixed lower grate assembly, and an end of the upper grate assembly mating with an end of the lower grate assembly;

a release device connected for actuation of the upper grate assembly; and a discharge conveyor for receiving the sufficiently reduced material which passes through the grate assembly to facilitate conveyance thereof away from the rotor;

wherein the material reducing apparatus further includes a control system which comprises an accelerometer supported by the rotor and coupled to the control system, and the accelerometer, upon detection of vibration, sending a signal to the control system and the control system, when the control system determines that the signal is of a sufficient magnitude, reverses a rotational direction of the feed roller and the feed conveyer so that the feed roller and the feed conveyer rotate to withdraw hard material, that is not readily shearable by the strikers, from contact with the rotor and the release device pivots the pivotally mounted upper grate assembly radially away from the rotor to form an ejection opening, in the grate assembly, for ejecting ungrindable material from the material reducing apparatus.

11. The material reducing apparatus according to claim 10, wherein the lower grate assembly is supported by shear pins which, when exposed to a predetermined force, will shear away and allow the lower grate assembly to fall away from the rotor.

12. The material reducing apparatus according to claim 11, wherein the control system further reduces a rotational speed of the rotor when the control system detects contact of the rotor with the hard material.

13. A material reducing apparatus comprising:

a feed conveyor for conveying material toward a reduction area;

a feed roller cooperating with the feed conveyor for assisting with conveying the material toward the reduction area;

a rotor being rotatably supported within the reduction area, the rotor supporting a plurality of strikers about a perimeter of the rotor, and rotation of the rotor causes the strikers to rotate along a circumferential path for impacting and reducing material;

an anvil being located radially adjacent the circumferential path of the strikers, and the anvil cooperating with the strikers to facilitate further reduction of the material;

an arcuate grate assembly comprises an upper grate and a lower grate, both the upper grate and the lower grate having apertures which permit sufficiently reduced material to pass therethrough, and a first end of the upper grate being pivotally fixed to the material reducing apparatus adjacent the anvil, and when the upper grate is in a closed position, the upper and the lower grates together define the arcuate grate assembly;

an accelerometer being supported by the rotor and communicating with a control system, and the accelerometer detecting rotor vibration as the rotor rotates and transmitting detected rotor vibration signals to the control system; and a release device communicating with the control system and being coupled to at least the upper grate, and the release device, upon the control device receiving a rotor vibration signal exceeding a threshold value, pivoting the upper grate from the closed position to an open position so as to form an ejection opening, between the upper and the lower grates, for ejection ungrindable material.

14. The material reducing apparatus according to claim 13, wherein the release device pivots the upper grate away from the rotor within about 200 milliseconds.

15. The material reducing apparatus according to claim 13, wherein the lower grate is fixed and is supported by shear pins which, when exposed to a predetermined force, will shear away and allow the lower grate to fall away from the rotor.

16. The material reducing apparatus according to claim 13, wherein the control system further reduces a rotational speed of the rotor when the control system determines that the rotor contacted the hard material.

17. The material reducing apparatus according to claim 13, wherein the accelerometer is supported by a bearing housing for the rotor.

18. The material reducing apparatus according to claim 13, wherein a discharge conveyor is located adjacent the grate assembly for receiving the sufficiently reduced material which passes through the openings provided within the grate assembly to facilitate conveyance thereof away from the material reducing apparatus.

19. The material reducing apparatus according to claim 15, wherein the material reducing apparatus is provided with stop pins which limit radially downward movement of the lower grate, away from the rotor, when the shear pins are sheared.

20. The material reducing apparatus according to claim 13, wherein the release device comprises an accumulator for storing a supply of hydraulic fluid, at least one cylinder which is connected to the pivoted end of the upper grate, and the accumulator is coupled to the at least one cylinder for supplying the hydraulic fluid thereto and biasing an internal piston of the cylinder to a position which pivots the upper grate away from the rotor and forms the ejection opening in the grate assembly.

* * * * *